United States Patent [19]

Cotton

[11] 4,185,671

[45] Jan. 29, 1980

[54] ACCESSORY FOR ROUTING APPARATUS

[75] Inventor: Lawrence M. Cotton, New Bern, N.C.

[73] Assignee: The Stanley Works, New Britain, Conn.

[21] Appl. No.: 943,569

[22] Filed: Sep. 18, 1978

Related U.S. Application Data

[63] Continuation-in-part of Ser. No. 744,528, Nov. 24, 1976, Pat. No. 4,114,664, Continuation-in-part of Ser. No. 744,528, Nov. 24, 1976, Pat. No. 4,114,664.

[51] Int. Cl.[2] ..... B27C 5/10

[52] U.S. Cl. ..... 144/134 D; 33/26; 144/137; 409/79; 409/218

[58] Field of Search ..... 144/137, 144 R, 149, 144/323, 134 D, 136 C; 33/26, 32 C; 90/12 R, 12 D, 13 R, 15 R, 15 A, DIG. 3

[56] References Cited

U.S. PATENT DOCUMENTS

| | | | |
|---|---|---|---|
| 3,531,865 | 10/1970 | Nelson | 33/26 |
| 3,541,922 | 11/1970 | Dunlap | 144/144 R |
| 3,543,636 | 12/1970 | Tracy | 144/144 R |
| 3,858,630 | 1/1975 | Cherry et al. | 144/144 R |

FOREIGN PATENT DOCUMENTS

| | | | |
|---|---|---|---|
| 316866 | 10/1956 | Switzerland | 144/134 D |

*Primary Examiner*—John Sipos
*Assistant Examiner*—W. D. Bray
*Attorney, Agent, or Firm*—Prutzman, Kalb, Chilton & Alix

[57] ABSTRACT

An accessory is provided for use with routing apparatus to facilitate the routing of arcuate designs in cabinet doors and similar panels. The routing apparatus is of the type in which a router is mounted on the end of a bar for extension over a panel to be routed and in which the router can be moved in any direction in a plane parallel to the panel by reason of the bar being mounted in a carrier for longitudinal movement in one dimension of the panel, and the carrier being mounted for movement parallel to the other dimension of the panel. The accessory comprises a radius arm which may be adjustably connected at one end to the bar and is slidably mounted in a pivot block mounted for movement in the same direction as the carriage. An adjustable stop on the radius arm limits its longitudinal movement and an adjustable stop limits movement of the pivot block whereby the router can be guided in a preselected curved path by causing the radius arm to pivot around the pivot block.

10 Claims, 3 Drawing Figures

ACCESSORY FOR ROUTING APPARATUS

RELATED APPLICATION

This application is a continuation-in-part of my copending application Ser. No. 744,528, filed Nov. 24, 1976, now U.S. Pat. No. 4,114,664 and entitled "Apparatus for Routing Designs in Panels."

SUMMARY OF THE INVENTION

The present invention relates to routing apparatus and is concerned, more particularly, with an accessory for use with routing apparatus of the type disclosed and claimed in my copending application Ser. No. 744,528 filed Nov. 24, 1976, and now issued as U.S. Pat. No. 4,114,664 dated Sept. 19, 1978. The accessory is provided to improve the capability of the routing apparatus for routing arc-shaped grooves in cabinet doors or other panels.

In routing apparatus of the type referred to, a router is mounted on the end of a bar which extends over the cabinet door or other panel so that the router can cut decorative grooves in the surface of the door or panel. The bar is mounted both for longitudinal reciprocal movement and for lateral rectilinear movement whereby when these movements are combined, the router is free, within limits, to move in any horizontal direction. Adjustable stops and templets are provided for controlling movement of the arm whereby the router may be guided for routing straight and curved lines in a predetermined pattern.

An object of the present invention is to provide an accessory for use with routing apparatus of the type referred to for guiding the arm and router in an arcuate path without the need for arcuate templates.

A further object is to provide such an accessory which is readily adjustable within reasonable limits for varying both the curvature and location of the arcuate groove to be routed.

Another object is to provide such an accessory which facilitates the routing of matching arcuate grooves in doors or other panels of different widths.

An additional object is to provide an accessory which is simple to use requiring minimum skill and instruction and which is accurate and dependable in operation and has a long service life.

Other objects will be in part obvious and in part pointed out in more detail in the following description and the accompanying drawings which set forth an illustrative embodiment of the invention.

DESCRIPTION OF THE PREFERRED EMBODIMENT

Figure 1:
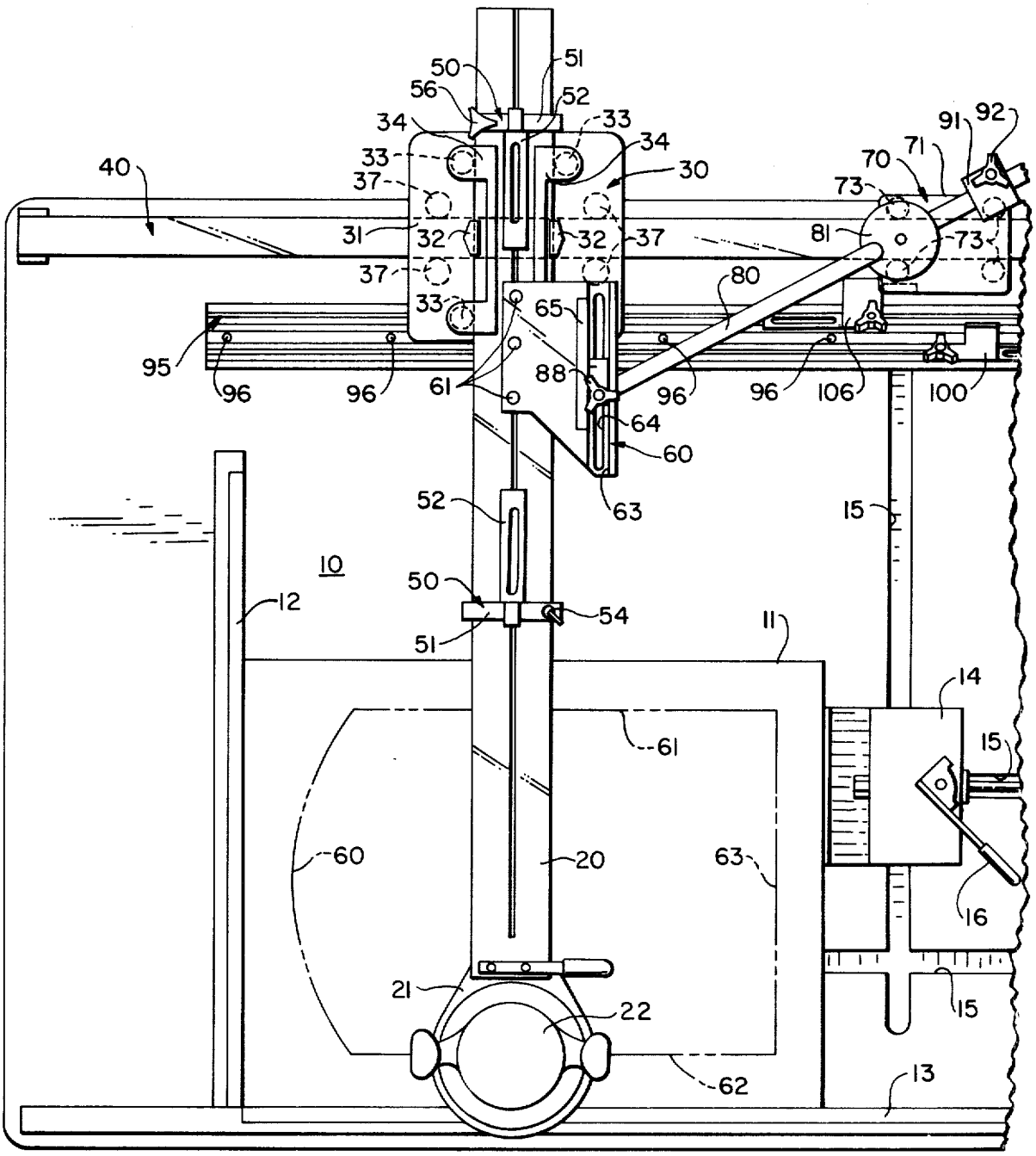
FIG. 1 is a plan view of an accessory embodying my invention and of a routing apparatus to which the accessory is applied.

With respect to the drawings showing a preferred embodiment of the invention, the accessory is associated with a routing apparatus of the kind disclosed and claimed in my prior U.S. Pat. No. 4,114,664. Only that portion of the routing apparatus necessary for an understanding of the operation and function of the accessory is shown and will be described in detail hereinafter. If further information concerning the routing apparatus is desired, reference may be had to the said prior U.S. Pat. No. 4,114,664.

Referring to the drawings in detail, the routing apparatus includes a base or work table 10 on which a panel 11 is placed for a routing operation. Defining one corner of the work area and for use in proper placement of a panel on the table are a pair of abutments or ledges in the form of elongated bars 12 and 13 secured to the surface of table at right angles to each other, the bar 12 being adjacent the left hand lateral edge of the table and the bar 13 being adjacent the bottom longitudinal edge as viewed in FIG. 1. The panel 11 to be worked upon is abutted against the bars 12, 13 and secured in place by a clamp 14 which is slidably received in the grooves 15 for movement to the desired clamping position and which can be secured in clamping position by locking means (not shown) operated by the handle 16.

Extending across the face of the work table and across the panel to be routed is a bar 20 extending parallel to the ledge 12. Pivotally mounted on the end of bar 20 is a universal type base plate 21 on which a conventional commercially available router 22 is attached.

The opposite end of the bar 20 is mounted for longitudinal movement in a carriage 30 which has a base plate 31 on which the bar 20 rests and on which it is slidably held by L-shaped hold down members 32. Spaced apart rollers 33 mounted on the base plate 31 snugly engage the side edges of the bar 20 permitting the bar to slide longitudinally but accurately positioning the bar so that it is at right angles to the carriage 30 and is restrained from pivoting or rocking in a horizontal plane relative to the carriage 30. The members 34 are dust covers to protect the bearings of the rollers 33.

The carriage 30 is mounted for sliding movement on a rail 40 which is T-shaped in cross-section and which is mounted on the table 10 by means of a longitudinally extending piano hinge 41 thereby permitting the rail 40 to pivot on an axis parallel to the longitudinal axis of the rail. The hinge 41 and rail 40 are precisely mounted on the table 10 so that rail 40 is parallel to the panel locating bar 13 and thus parallel to the longitudinal edges of a panel 11 clamped against the bar 13.

The base plate 31 of the carriage 30 rides on the top of the rail 40 and is retained thereon by rollers 35 secured on opposite sides to the plate 31 by brackets 36 so that they engage under the shoulders 42 of the rail. Guide rollers 37 mounted on the underside of plate 31 snugly engage the side edges of the shoulders 42 of the rail 40 to prevent pivoting of the carriage 30 relative to the rail 40 but at the same time permitting the carriage 30 to slide easily along the rail 40.

The limits of longitudinal movement of the bar 20 are controlled selectively by means of adjustable stops 50 mounted on the bar 20 on opposite sides of the carriage 30. Each stop 50 is of T-shaped configuration with a cross-piece 51 and a center longitudinally extending portion 52. The end portions of the cross-piece 51 are bent down and around the side edges of the bar 20 to position the cross-piece 51 at right angles to the bar but allowing sliding movement of the stop 50 longitudinally of the bar 20 to permit its position to be adjusted. Each of the stops 50 can be held in adjusted or preselected position by operation of a locking handle 54 in the case of bottom stop 50 and to a knob 56 in the case of the other stop. The wrapped around end portions limit longitudinal movement of the bar by engaging against the adjacent edge of the carriage base plate 31.

With the structure as thus far described, it will be apparent that inasmuch as the carriage 30 is movable along the rail 40 and the bar 20 is movable longitudinally in the carriage 30, the router base plate 21 can be moved in any direction (within limits) in a plane parallel to the upper surface of the panel 11.

Figure 3:
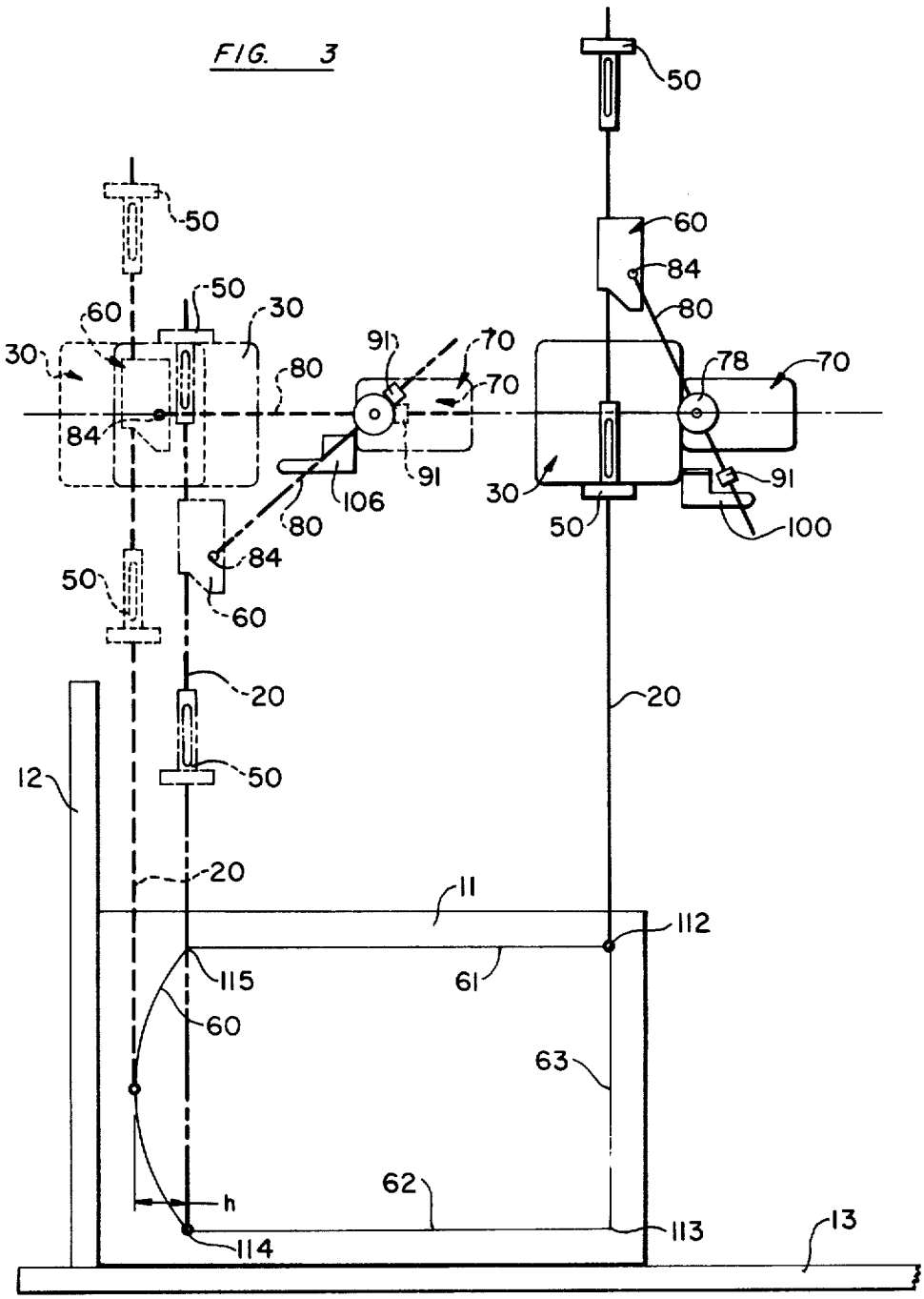
FIG. 3 is a schematic drawing partially in phantom illustrating the operation of the accessory in combination with the routing apparatus.

The accessory of the present invention comprises the additional elements to be next described which are mounted and used in conjunction with the routing apparatus for guiding the bar 20 which in turn guides the router 22 for routing an arc-shaped groove as represented by the arcuate line 60 in FIGS. 1 and 3. The principal use of the accessory is in connection with routing a design in the surface of a rectangular cabinet or other panel which consists of the arcuate groove denoted by the line 60 in combination with two straight margin grooves denoted by the lines 61, 62 and an opposite straight groove denoted by line 63. This is a commonly desired design for door panels, the arcuate groove being disposed at the top of the panel and the straight grooves at the sides and bottom. Accordingly, to route such a design in the panel 11, the panel is placed on the base or table 10 with its top edge abutted against the locating bar 12 and with its left hand edge abutted against the locating bar 13.

Principal elements of the accessory of my invention may comprise:

(1) a slotted bracket 60 adapted to be attached to the bar 20, (2) a pivot block assembly 70 adopted to be slidably mounted on the rail 40, (3) a radius arm 80 adapted to be slidably mounted in the pivot block assembly 70 and to be attached at one end to the slotted bracket 60, and (4) an auxilliary rail 95 adapted to be mounted on the base 10 parallel to the rail 40 having adjustable stops 100, 106 for controlling travel of the carriage 30 and pivot block assembly 70.

Turning first to the slotted bracket 60, this is a flat plate having the configuration shown. It is attached by screws 61 to an elongated base 62 extending along one edge which is adapted to be secured to the upper surface of the bar 20 intermediate the margin stops 50. The base 62 elevates the plate well above the carriage 30 on which the bar is slidably mounted. The bracket 60 has an elongated and wide groove 63 extending alongside its outer edge and an elongated slot 64 therein, the slot 64 extending parallel to the bar 20. A scale 65 is provided alongside the groove 63 for a purpose to be explained later.

The pivot block assembly 70 comprises a generally rectangular carriage plate 71 adapted to be slidably mounted on the rail 40. A replaceable thin wear sheet 72 is secured to the underside of plate 71 to ride on the top of rail 40. Plate 71 has four bearings 73 mounted on its underside, one adjacent each of the four corners, which bearings are mounted for rotation in a horizontal plane and engage on opposite sides of the rail 40. The carriage plate 71 is retained on the rail 40 by rollers 35 mounted on brackets 36 like the carriage plate 31. Threadably mounted on the top side of the plate 71 is a vertical pivot pin 76 mounting a bearing 77 on which is rotably mounted a generally cylindrical pivot block 78. The radius arm 80, to be next described, is slidably received in a diametrical slot 79 in the top of the block 78. The top of the block 78 is covered with a cover plate 81 secured thereto by screws 82.

The radius arm 80 is preferably of rectangular cross-section as shown and at its free end houses a bearing 83 in which is supported a vertical pivot pin 84 that extends upwardly through the slot 64 in the bracket 60. The pin 84 has an enlarged portion 85 forming a shoulder which engages against the underside of the bracket 60, a section of smaller diameter 86 which extends into the slot 64 and a threaded portion 87 on which is threaded the knob 88. The threaded portion 87 also extends through an indicator plate 89 which is slidable in the groove 63 and has indicia thereon for use in cooperation with the scale 65 when selecting the longitudinal location of the pivot pin 84 in the slot 64. When the pivot pin 84 is in desired position, it can be clamped in this position by turning down the knob 88 against the washer 90 and indicator plate 89.

Mounted on the opposite end of the radius arm 80 is an adjustable stop in the form of a clamp 91 which can be tightened or loosened by turning the knob 92. When loosened, the clamp can be moved along the arm 80 to a selected position. As explained more fully hereinafter, the stop clamp 91, by abutting against the pivot block 78 when the arm 80 is extended, determines the permitted extension of the arm 80 and, therefore, its effective length as a radius arm for controlling the path of movement of the router 22.

Figure 2:
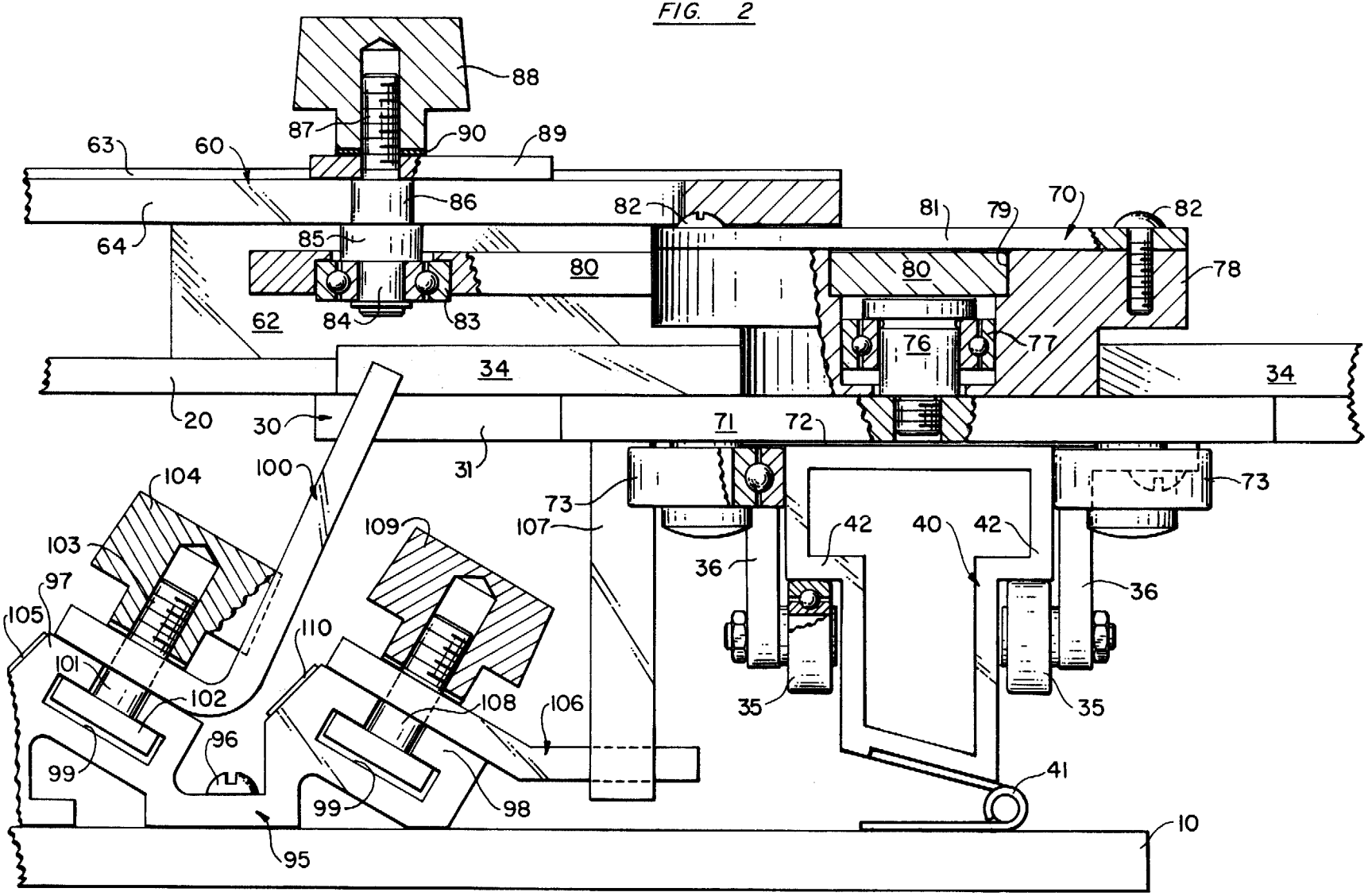
FIG. 2 is an end view, partially in section, of the apparatus and accessory shown in FIG. 1, the view being taken from the right hand end as viewed in FIG. 1.

The auxilliary rail 95 which can be mounted on the base 10 parallel to the rail 40 by means of screws 96, consists of two parallel tracks 97 and 98. Each of the tracks is slightly canted as shown in FIG. 2 and has a longitudinally extending channel 99 which is of inverted T cross-section. Track 97 is used to position a stop 100 which is a plate bent at nearly a right angle as shown in the drawing so that when mounted on the track 97 it will extend upwardly as viewed in FIG. 2 sufficiently to extend into the path of the main carriage 30. A stud 101 having an enlarged head 102 which is slidably engaged in the channel 99 has a threaded end 103 extending upwardly through a hole in the base of the stop plate 100 on which is threaded the knob 104. By turning the knob 104, the stop plate 100 can be clamped in any selected longitudinal position on the track 97. A scale 105 is provided along one edge of track 97 to aid in properly positioning the stop 100.

Similarly, track 98 is used to position a stop 106 which is bent at an obtuse angle to extend inwardly toward the rail 40 into the path of a depending bar 107 secured to the underside of the carriage plate 71 of the pivot block assembly 70. A threaded stud 108 similar to stud 101 in conjunction with the knob 109 permits the stop 106 to be clamped in selected longitudinal position on the track 98. A scale 110 along the edge of track 98 may be used in the positioning of stop 106.

It is believed that the operation of the arc accessory of my invention in combination with a routing apparatus of the type described will be readily understood from the foregoing description taken together with the following explanation in connection with the schematic view of FIG. 3. The first step in setting up the apparatus for routing the design shown in FIGS. 1 and 3 is to properly position the stops 50 on the bar 20 so as to provide the desired margins for the cuts to be routed along the lines 61 and 62. This is explained in detail in my prior U.S. Pat. No. 4,114,664. The next step is to position the stop 100 so that it will be engaged by the carriage 30 when the router 22 is in the proper lateral position for routing the line 63. The last step is to adjust the radius arm 80 which comprises first locating the pivot pin 84 in slot 64 of the bracket 60 so that it is midway between the stops 50. This is simplified by having the scale 65 calibrated in accordance with the widths of the panels to be routed. The adjustable stop 91 is then located so as to provide the effective length of the radius arm 80 required to effect the desired radius of curvature of the line 60 and the stop 106 is located so that it will block movement of the pivot block assembly 70 to the left as viewed in FIGS. 1 and 3, thus establishing the center about which the router will pivot when routing along the line 60. If desired, a chart may be provided for setting the positions of the stops 91 and 106 based on the formula $r=(c^2+4h^2/8h)$ where r=effective radius of the radius arm 80 c=panel width minus margins for the lines 61, 62 h=the height of the arc 60 indicated by the dimension denoted as "h" in FIG. 3

After the arc accessory and routing apparatus have been adjusted as described, a typical routing operation for creating the design as shown may be performed as illustrated diagramatically in FIG. 3. Assuming the parts are in the solid line position as shown in FIG. 3 with the forward stop 50 engaged against the main carriage 30 and the main carriage 30 engaged against the stop 100, the router bit will then be located at the corner 112 of the design and the operator, by drawing the router forwardly while maintaining the carriage 30 against the stop 100 will rout along the straight line 63 until the rear stop 50 engages the carriage 30 at which time the router bit will be at the corner 113. The operator can then move the router to the left while maintaining the rear stop 50 against the carriage 30 causing the routing of the straight line 62 until the corner 114 is reached. At this point the radius arm will have slid through the pivot block 78 until stop 91 engages the pivot block 78 and the pivot block assembly 70 will have slid along the rail 40 until it engages the stop 106. Maintaining the parts in this position, the router can now be moved along the arc 60 being guided by the radius arm 80 until the corner 115 is reached. At this point, the forward stop 50 will have become reengaged with the main carriage 30 and maintaining this relationship, the router can now be moved along the straight line 61 to the starting corner 112 thus completing the routing of the design.

As will be apparent from the foregoing description and explanation, the accessory of my invention is easy to apply to routing apparatus of the type referred to and is simple to use with accuracy and reliability. Furthermore, the accessory not only permits the rapid reproduction of the same design on a sequence of panels of the same size, but it also permits the rapid reproduction of matching designs in a sequence of panels of different widths because of the ease and accuracy of predetermining the same shoulder height and margin of the arcuate routing regardless of variations in panel width.

As will be apparent to persons skilled in the art, various modifications, adaptations and variations of the foregoing specific disclosure may be made without departing from the teachings of the present invention.

I claim:

1. An accessory for use with routing apparatus of the type having a base, means for securing a panel to be routed in predetermined position on the base, a rail extending parallel to one edge of a panel secured in said predetermined position, a bar extending over the base having means for mounting a router on the end thereof, and means for mounting the bar on the rail for longitudinal reciprocal movement and transverse rectilinear movement, said accessory comprising:

a. a radius arm adapted to be attached at one end to the bar;

b. mounting means mounting the radius arm for longitudinal reciprocal movement and pivotal movement and adapted to be mounted on the rail for movement along the rail;

c. adjustable stop means for limiting longitudinal reciprocal movement of the radius arm; and d. adjustable stop means for limiting movement of said mounting means along the rail.

2. An accessory as defined in claim 1 wherein the bar of the routing apparatus has a pair of spaced apart adjustable stop means for limiting reciprocal movement of the bar, and the radius arm is attached to the bar intermediate the said adjustable stop means.

3. An accessory as defined in claim 2 wherein the radius arm is attached to the bar by means of a bracket adapted to be secured to the bar intermediate the said adjustable stop means having an elongated slot parallel to the bar, and the radius arm is pivotally attached to a pivot pin provided with means for securing the pivot pin in selected position in the elongated slot.

4. An accessory as defined in claim 1 wherein the adjustable stop means for limiting reciprocal movement of the radius arm is a stop slidable longitudinally of the radius arm on the end opposite from the end secured to the bar having means for securing the stop in selected longitudinal position on the radius arm.

5. An accessory as defined in claim 1 wherein the said mounting means for the radius arm comprises a carriage adapted to be mounted on the rail for longitudinal movement thereon.

6. An accessory as defined in claim 1 wherein a rotatable pivot block is mounted on the carriage and the radius arm extends through an opening in the pivot block.

7. An accessory as defined in claim 6 wherein the adjustable stop means on the radius arm is a clamp on the radius arm which limits longitudinal extension of the radius arm by abutting the pivot block.

8. An accessory as defined in claim 1 in which there is also provided an auxilliary rail adapted to be mounted on the base adjacent the rail of the routing apparatus in parallel relationship thereto, and the said adjustable stop means for limiting movement of the radius arm mounting means is a stop adjustable longitudinally of the auxiliary rail.

9. An accessory as defined in claim 8 wherein an additional adjustable stop means is provided on the auxilliary rail which is adapted to limit movement of the bar mounting means along the rail of the routing apparatus.

10. An accessory as defined in claim 9 wherein the auxilliary rail is formed with a pair of parallel tracks and the adjustable stop means for limiting movement of the bar mounting means is mounted on one of the tracks and the adjustable stop means for limiting movement of the radius arm mounting means is mounted on the other of said tracks.

* * * * *